United States Patent [19]

Tsuyama

[11] 3,947,011

[45] Mar. 30, 1976

[54] CLAMP USABLE AS JIG AND LIFTING CLAMP

[76] Inventor: Yoshizo Tsuyama, No. 2698-2 Futana-cho, Nara, Nara, Japan

[22] Filed: Mar. 19, 1975

[21] Appl. No.: 559,630

[30] Foreign Application Priority Data

May 16, 1974 Japan ..... 49-54843

[52] U.S. Cl. ..... 269/249; 269/258; 269/261; 294/101

[51] Int. Cl.[2] ..... B25B 1/10

[58] Field of Search ..... 269/249, 258, 261, 95; 294/101, 103

[56] References Cited

UNITED STATES PATENTS

| | | | |
|---|---|---|---|
| 2,346,088 | 4/1944 | Shobert | 269/258 |
| 2,548,401 | 4/1951 | Sherwood | 294/103 |
| 3,258,821 | 7/1966 | Curran | 269/249 |
| 3,269,766 | 8/1966 | Gardner | 294/101 |
| 3,300,242 | 1/1967 | Renfroe | 294/101 |

FOREIGN PATENTS OR APPLICATIONS

| | | | |
|---|---|---|---|
| 322,410 | 7/1957 | Switzerland | 294/103 |

*Primary Examiner*—James L. Jones, Jr.
*Assistant Examiner*—Robert C. Watson

[57] ABSTRACT

There is provided a clamp which is well suited for use as a lifting clamp for lifting and moving materials of assembly in a shipyard, etc. and as a pulling jig in welding and other operations. The clamp comprises a clamp body including a shackle for engagement with a pulling device and a slot for receiving an article, and a pair of jaws provided on the leg portions of the clamp body on the opposite sides of the slot to grip the article in the slot, one of said jaws consisting of a screw rod and the other jaw consisting of a swivel jaw with a spherical surface, whereby when the article clamped in the slot by the pair of jaws tends to slide in any direction with respect to the clamp body, the article is more positively gripped by the pair of jaws.

5 Claims, 2 Drawing Figures

CLAMP USABLE AS JIG AND LIFTING CLAMP

BACKGROUND OF THE INVENTION

The present invention relates to a clamp well suited for use as a jig whereby materials of assembly may be pulled nearer and held in position for welding or bolting together in a shipyard or in a construction field of a building or bridge and as a lifting clamp for lifting and moving such materials.

In a shipyard, for example, operations frequently take place where steel materials which are to be assembled are lifted and lowered by a crane and they are then welded or bolted to the steel materials on a bed or berth. In this case, in order that two steel materials to be jointed may be held close together at proper positions to prevent them from slipping out of the positions during the joining operation, these steel materials must be pulled toward each other by means of wires and then held in their proper positions. In the past, to fasten a wire to each of these steel materials, it has been customary to preliminarily attach an eye-piece to the steel material by welding. However, the welding of eye-pieces to steel materials and their removal after the completion of joining operation require much labor and considerably deteriorate the operating efficiency.

Some clamps are known in the art which are used as removable jigs in place of such eye-pieces and which comprise a shackle on the top of the C-shaped clamp body and a threaded rod mounted in the bottom portion of the clamp body to be driven upwardly, whereby the threaded rod is turned to fasten the clamp on the steel material. A disadvantage of this type of clamp is that the fastening of the clamp on the steel material relies solely on the locking force of the threaded rod and therefore there is the danger of the gripped steel material slipping out of the clamp.

On the other hand, as an improvement of the above-described clamps of the screw type, a clamp has been proposed (U.S. Pat. application Ser. No. 401,562 filed Oct. 5, 1964) wherein an oscillating jaw employing a ball joint is provided on the screw rod to impose an automatic wedging action on the gripped article when it tends to slip out. A disadvantage of this type of clamp is that the structural strength of the ball joint portion is low, and moreover the other jaw must be provided with a mechanism which operates in association with the movement of the oscillating jaw, thus making the construction of the clamp more complicate.

SUMMARY OF THE INVENTION

The present invention relates to a clamp of the type wherein the article received in the slot formed in the clamp body is gripped by a pair of jaws mounted on the two leg portions on the opposite sides of the slot. One of the jaws consists of a screw rod which is movable to advance or retard relative to the article in the slot in an internally threaded through hole provided in one of the leg portions, and the other jaw consists of a swivel jaw which is mounted in a recess formed in the other leg portion to positively receive the surface of the article pressed against the other leg portion by the locking force of the screw rod, and which is adapted to rotate within the complementary spherical surface of the recess and move toward the surface of the article in accordance with the shifting of the surface of the article tending to slip out of the position in the slot.

The swivel jaw comprises a cylindrical gripping member which is provided on its front end with a plurality of ring-like protrusions arranged concentrically to form a curved surface on the whole and on its rear end with a sliding curved surface adapted to contact with the bottom portion of the recess in the leg portion, and a ring which encloses the gripping member to be slidable along its central axis and which is provided with a spherical outside surface. Further, in principle, each of the average curved surface of the gripping head on the front end of the cylindrical gripping member and the curved surface on its rear end forming a smooth sliding surface is formed so that the distance between the center of rotation of the swivel jaw and the central surface on each end of the gripping member is shorter than the distance between the center of rotation of the swivel jaw and the peripheral surface on each end of the gripping member. Consequently, when the article gripped between the gripping head of the screw rod and the gripping head on the gripping member of the swivel jaw in the slot tends to slip out of the slot, due to the friction between the gripping member and the article, the gripping member rotates, along with the surrounding ring having the spherical surface, in the recess formed in the leg portion. When this occurs, the head on the gripping member comes into contact with the article at a position which is circumferentially displaced from the center toward the peripheral portion and which thus has a longer radius from the center of the gripping member, and the sliding surface on the rear end of the gripping member also comes into contact with the bottom of the recess in the leg portion at its circumferentially displaced position which has a longer radius from the center of the gripping member. In this way, the cylindrical gripping member is slidingly moved up in the ring of the swivel jaw to more positively grip the article. Since this positive gripping of the article is accomplished by the screw rod mounted on one leg portion and the bottom portion of the recess in the other leg portion through the intermediary of the gripping member, the use of this swivel jaw has the effect of providing the clamp with a very strong structure.

However, the ends of the cylindrical gripping member in the above-described swivel jaw need not always be shaped into the above-mentioned fundamental forms. While it is essential that the curved surface on each end of the cylindrical gripping member consists of a continuous convex curved surface, it is only necessary that either one of the average curved surface of the front end gripping head and the rear end sliding curved surface is formed into the above-mentioned fundamental shape provided that the gripping member functions in such a manner that the distance between the bottom of the recess in the leg portion and the surface of the article contacting with the head of the gripping member is spread when the jaw rotates to tilt the cylindrical gripping member.

It is therefore an object of the present invention to provide a locking screw rod type clamp stronger in construction and having a wedging mechanism.

It is a more specific object of the present invention to provide a clamp comprising a swivel jaw mounted in the recess formed in one leg portion of the clamp body, whereby when the swivel jaw rotates slidingly at the spherical surface of a ring constituting part of the swivel jaw, a cylindrical gripping member mounted in the ring to be slidable along its central axis is tilted to provide a wedging action which spreads the distance between the leg portion and the article.

It is still another specific object of the invention to provide a clamp comprising a swivel jaw mounted on one of the opposed leg portions of the clamp body, and another jaw mounted on the other leg portion and consisting of a screw rod, wherein the surface of the gripping head on the locking screw rod is formed with the most projecting conical protrusion located on the axis of the screw rod and a plurality of lower concentric circular protrusions arranged around the central protrusion, whereby the locking of an article by the locking screw rod is facilitated.

The above and other objects, features and advantages of the present invention will become readily apparent from considering the following detailed description taken in conjunction with the accompanying drawings.

DESCRIPTION OF PREFERRED EMBODIMENT

Figure 1:
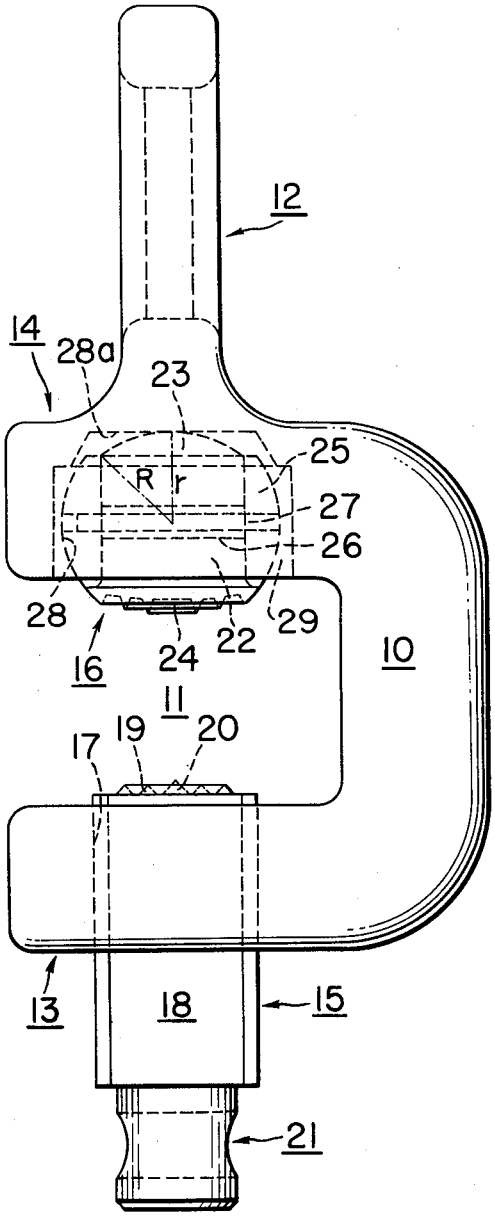
FIG. 1 is a side view showing a clamp according to an embodiment of the present invention.
Figure 2:
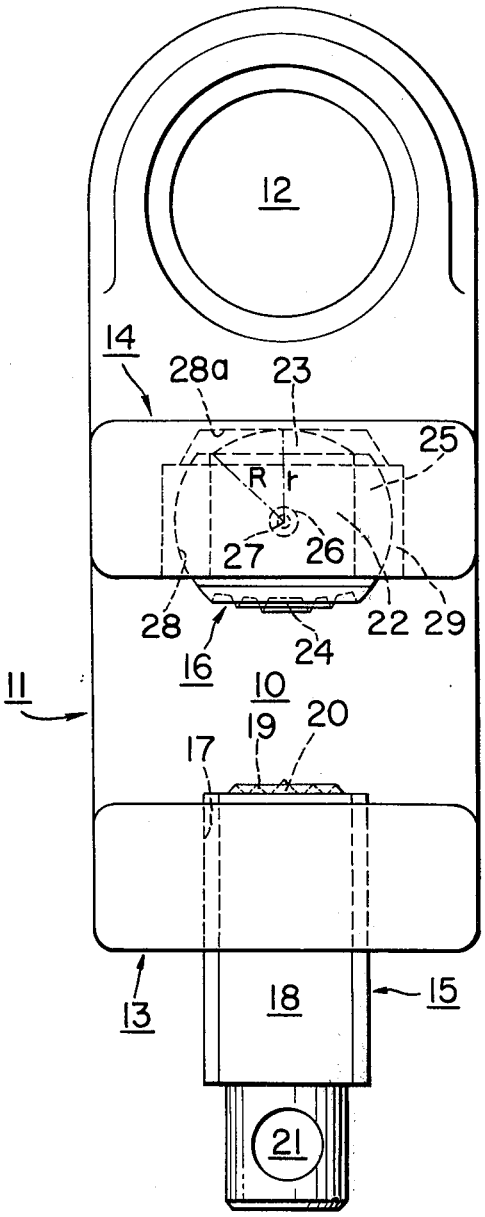
FIG. 2 is a front view of the clamp shown in FIG. 1.

As mentioned earlier, the present invention relates to a jig clamp which is also useful as a lifting clamp. A preferred embodiment of the invention is illustrated in FIGS. 1 and 2 of the accompanying drawings.

The illustrated clamp comprises a clamp body 10 which has the practically C-shaped profile. The clamp body 10 is made of a single steel material, and a slot 11 for receiving an article to be clamped is defined practically in the central portion of the clamp body. Integrally formed with the clamp body 10 is a shackle 12 extending in a direction which crosses the slot 11 at right angles.

The clamp provided with such a shackle is generally used in place of an eye-piece which is employed to adjust the relative position of materials of assembly such as steel frames and steel plates used in the construction and assembling of a building, bridge or hull blocks. For instance, this clamp is fastened on each of two members to be welded together, e.g., a plate member and a structural member so that they are pulled toward each other by a chain block, or the clamps are moved away from each other by a jack to lock the two members in the desired positions.

However, the illustrated clamp is also usable as a lifting clamp, e.g., the position of the shackle 12 on the clamp body 10 may be changed in different ways to use it as a lifting clamp.

The C-shaped clamp body 10 includes a pair of leg portions 13 and 14, and a pair of opposed jaws 15 and 16 are respectively mounted on the leg portions 13 and 14 to grip an article received in the slot 11.

Of the pair of jaws, the jaw 15 mounted on the leg portion 13 consists of an article locking screw rod 18 which is fitted to advance or recede in an internally threaded hole 17 formed in the leg portion 13 to cross the slot 11 at right angles. The end face of the screw rod 18 that faces the slot 11, is formed with a plurality of sharp concentric circular protrusions thus forming a gripping head that prevents slipping between the rod 18 and the article. Preferably, the screw rod 18 has a considerably large diameter, and it must be strong enough to lock and hold the article in position. In the illustrated embodiment, this gripping head is provided, in addition to the plurality of concentric circular protrusions 19, with a conical protrusion 20 which is slightly higher and sharper than the protrusions 19. When the screw rod 18 has been moved to lock the article in the slot 11 and the gripping head has contacted with the surface of the article, the sharp end of the protrusion 20 bites first into the surface of the article to prevent the turning screw rod 18 from turning around a point other than this point on the axis, and then the screw rod 18 is allowed to turn smoothly around the protrusion 20 now serving as a fulcrum and thereby to ensure a more positive gripping of the article in the slot by the locking force of the screw.

The other end of the screw rod 18, i.e., the base portion extending to the outside of the clamp body 10 is formed with a hole 21 into which is inserted a handle bar (not shown) which is turned by the operator to move the screw rod 18.

Disposed opposite to the jaw 15 constituted by the screw rod 18 is the swivel jaw 16 which is mounted on the leg portion 14 and which comprises a cylindrical gripping member 22 and a ring 25 having a spherical outside surface. The cylindrical gripping member 22 of the swivel jaw 16 consists of a circular cylinder of a considerably large diameter which is about the same as that of the screw rod 18 of the jaw 15, and this circular cylinder is provided on its rear end with a curved surface 23 which is formed so that the radius extending from the center of rotation of the swivel jaw 16 to the curved surface 23 gradually increases as the point on the curbed surface 23 is displaced from the central surface portion toward the peripheral surface portion (e.g., $r<R$). The gripping member 22 is also provided on its front end with a gripping head comprising a plurality of cencentrically arranged circular protrusions 24. The concentric protrusions 24 on this gripping head generally forms a curved surface which is designed to provide a sufficient contacting surface with an article in the slot 11 when the jaw 16 rotates, and this curved surface is also designed so that the radius extending from the center of rotation of the jaw 16 to the curved surface gradually increases in principle as the point on the curved surface is displaced from the central surface portion toward the peripheral surface portion.

The outer surface of the cylindrical gripping member 22 forms an exact spherical surface, and it is close fit in a ring 25 having a cylindrical void on the inner side so that the gripping member 22 is slidable in the ring 25 along the direction of its central axis. The cylindrical gripping member 22 is joined with the ring 25 by means of a pin 27 which is threadedly secured to the ring 25 through a through hole 26 having an axial clearance.

The gripping member 22 and the ring 25 thus integrally combined together is slidably and rotatably mounted in the recess formed in the leg portion 14 by means of a socket member 29 formed on its inner side with a complementary concave surface 28 which forms a complementary surface for the spherical surface of the ring 25. The socket member 29 has a cylindrical outer surface and it is vertically splitted into two so that the socket member 29 is inserted into the recess of the leg portion 14 after it has been placed to surround the ring 25. The socket member 29 is locked by bolts (not shown) externally screwed thereinto through the leg portion 14 to support the swivel jaw 16 on the leg portion 14. In this case, the cylindrical gripping member 22 is positioned so that the sliding curved surface 23 on the rear end of the cylindrical gripping member 22 comes into contact with a bottom surface 28a of the recess in the leg portion 14.

Assume now that an article has been received in the slot 11 of the illustrated clamp and the screw rod 18 has been driven fully by the handle lever. In this case, the gripping member 22 and the ring 25 of the swivel jaw 16 are in the illustrated positions. When a pulling force is applied to the clamp gripping an article so that the article tends to slip out of the opening of the slot 11 in the C-shaped clamp, the swivel jaw 16 is rotated in a clockwise direction (FIG. 1) due to the friction between the gripping head and the article. In this case, the center of rotation of the swivel jaw 16 is the center of the sphere defined by the inner concave surface of the socket member 29. Consequently, the point at which the curved surface of the gripping head of the gripping member 22 contacts with the article is displaced from the central portion to the peripheral portion. The distance between this peripheral portion and the center of rotation of the swivel jaw 16 is longer than the distance between the central portion and the center of rotation, and therefore the gripping head bites deeper into the surface of the article. If the operation is limited to this biting or wedging action, it is equivalent to the operation of the conventional oscillating jaw of this type. However, with the swivel jaw used in the illustrated embodiment, the similar wedging action is provided by virtue of the sliding curved surface 23 on the rear end of the gripping member 22 in addition to the wedging action provided by the curved surface of the gripping head. Because the sliding curved surface 23 is designed so that similarly with the curved surface of the gripping head, the distance between the center of rotation of the swivel jaw 16 and the peripheral surface portion of the sliding curved surface is longer than the distance between the same center of rotation and the central surface portion of the sliding curved surface 23.

It will thus be seen that in the illustrated embodiment, even a slight rotation of the swivel jaw 16 causes the contacting surface of the gripping head with the article to be forced out by virtue of the curved surfaces on the front and rear ends of the gripping member 22, thus producing a sufficient gripping force on the whole. In other words, the slipping of the article out of the slot in the clamp is limited to a very small degree, and it is possible to practically eliminate the slipping of the article at the gripping head of the screw rod 18.

While, in the embodiment described above, both of the front and rear ends of the gripping member 22 are provided with the respective curved surfaces designed to provide the respective wedging actions, the same results may be obtained by providing either one of the front and rear ends with a spherical surface whose center coincides with the center of rotation of the swivel jaw 16, or contrary to the illustrated embodiment each of the curved surfaces may be designed so that the radius extending from the center of rotation to the central portion of the curved surface is larger than the radius extending from the center of rotation to the peripheral portion of the curved surface. However, the gripping head may be moved in an amount equivalent to that obtained in the illustrated embodiment by increasing the distance between the center of rotation and the central portion of the curved surface over that between the center of rotation and the peripheral portion of the curved surface to an extent that the one curved surface makes up for the dimension of the other curved surface. With the clamp according to this modified form, however, when an article is gripped by the clamp, the line of action of the gripping force by the clamp greatly deviates from the center of the gripping member 22, and therefore, if possible, the ends of the gripping member should preferably be provided with the above-mentioned fundamental curved surfaces.

Further, a smooth wear resisting material having a high degree of hardness such as 18-8 stainless steel should preferably be used for the bottom portion of the recess in the leg portion which comes into sliding contact with the curved surface on the rear end of the gripping member. Furthermore, the ring-like protrusion formed at the center of the gripping head of the gripping member should preferably be made to have a fairly large area so that the ring-like protrusion snugly rests on the surface of an article when it is locked in position by the screw rod. In this way, when the article is gripped, the swivel jaw may be automatically placed in the proper position without using any auxiliary devices.

It will thus be seen from the foregoing that the present invention provides a screw type clamp having a wedging mechanism which is free from trouble and strong by virtue of the fact that the load acting on the swivel jaw which performs a wedging action is directly borne by the leg portion of the clamp body. The wedging mechanism of the clamp allows only a very limited amount of slipping to the gripped article, and this results in the simplified construction of the associated jaw, thus ensuring a high degree of reliability in the operation of the clamp.

What is claimed is:

1. A clamp comprising a clamp body including a shackle for engagement with pulling means and a slot for receiving an article, and a pair of jaws mounted on opposed leg portions on opposite side of said slot for cooperatively gripping said article in said slot, wherein one of said jaws is comprised of a screw rod having a gripping head formed on the front end thereof and threadedly mounted on one of said leg portions to be movable back and forth relative to said article gripped in said slot, the other of said jaws is comprised of a substantially cylindrical gripping member having a gripping head formed on the front end thereof and a ring slidably mounting said gripping member through the center thereof and having a spherical outer surface, said the other jaw being rotatably mounted in a recess formed in the slot side wall portion of the other of said leg portions with said spherical outer surface in slidable contact with the inner wall of said recess, and said gripping member is formed whereby at least one of the average curved surface of said gripping head formed on the front end of said gripping member and the curved surface formed on the rear end of said gripping member for sliding contact with the bottom wall of said recess is formed so that a radius extending from the center of rotation of said rotatable jaw to the peripheral portion of said curved surface is greater than a radius extending from the center of rotation of said rotatable jaw to the central portion of said curved surface.

2. A clamp according to claim 1, wherein said gripping head of said gripping member is provided with a curved surface of an extent sufficient for positively gripping an article, and the sliding curved surface on the rear end of said gripping member is formed in such a manner that a radius extending from the center of rotation of said rotatable jaw to the peripheral portion of said sliding curved surface is greater than a radius extending from the center of rotation of said rotatable jaw to the central portion of said sliding curved surface, whereby when said rotatable jaw is rotated by said article tending to slip out of said slot, said gripping member is forced out of said ring in which said gripping member is rotated.

3. A clamp according to claim 1, wherein said gripping head of said gripping member is provided with a ring-like protrusion at the center thereof, and a plurality of ring-like protrusions arranged concentrically around said central protrusion.

4. A clamp according to claim 1, wherein a wear resisting material having a high degree of hardness is provided on the bottom portion of said recess in said the other leg portion with which said curved surface on the rear end of said gripping member comes into sliding contact.

5. A clamp according to claim 1, wherein said gripping head of said screw rod constituting said one jaw is comprised of a conical protrusion located on the axial center line of said screw rod, and a plurality of circular protrusions arranged concentrically around said conical protrusion and slightly lower than said conical protrusion.

* * * * *

UNITED STATES PATENT OFFICE
CERTIFICATE OF CORRECTION

PATENT NO. : 3,947,011

DATED : Mar. 30, 1976

INVENTOR(S) : Yoshizo Tsuyama

It is certified that error appears in the above-identified patent and that said Letters Patent are hereby corrected as shown below:

In the heading, between items [76] and [22], insert:--

[73] Assignees: Mitsubishi Jukogyo Kabushiki Kaisha, of Tokyo, and Eagle Clamp Co., Ltd., of Nara City, both Japan Signed and Sealed this Fourteenth Day of September 1976

[SEAL]

*Attest:*

RUTH C. MASON
*Attesting Officer*

C. MARSHALL DANN
*Commissioner of Patents and Trademarks*